US007604090B2

(12) United States Patent
Tashiro

(10) Patent No.: US 7,604,090 B2
(45) Date of Patent: Oct. 20, 2009

(54) CIRCUIT-UNIT-COMBINED SPEAKER APPARATUS

(75) Inventor: Takahiro Tashiro, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 250 days.

(21) Appl. No.: 11/230,380

(22) Filed: Sep. 19, 2005

(65) Prior Publication Data

US 2006/0060416 A1 Mar. 23, 2006

(30) Foreign Application Priority Data

Sep. 22, 2004 (JP) ..... 2004-275139

(51) Int. Cl.
*H04R 1/02* (2006.01)

(52) U.S. Cl. ..... 181/199; 181/148; 381/335

(58) Field of Classification Search ..... 181/199, 181/148; 381/335; 455/347, 348, 349, 350, 455/351

See application file for complete search history.

(56) References Cited

U.S. PATENT DOCUMENTS

| | | | | |
|---|---|---|---|---|
| 2,852,706 | A * | 9/1958 | Combs | 307/150 |
| 3,023,274 | A | 2/1962 | Shaw | |
| 3,052,758 | A | 9/1962 | Berry | |
| 3,183,305 | A | 5/1965 | Jespersen | |
| 4,052,561 | A * | 10/1977 | Molay | 381/75 |
| 4,076,957 | A * | 2/1978 | Molay | 381/75 |
| 4,843,624 | A * | 6/1989 | Rashak | 381/91 |
| 5,390,246 | A * | 2/1995 | Gay et al. | 381/82 |
| 5,933,507 | A * | 8/1999 | Woolley et al. | 381/300 |
| 6,437,230 | B2 | 8/2002 | Torii et al. | |
| 6,968,067 | B2 * | 11/2005 | Lopez | 381/334 |
| 2002/0085730 | A1 | 7/2002 | Holland | |
| 2004/0109573 | A1 | 6/2004 | Haba | |
| 2005/0254678 | A1 * | 11/2005 | Wearing | 381/334 |
| 2005/0281426 | A1 * | 12/2005 | Peavey | 381/334 |

FOREIGN PATENT DOCUMENTS

| | | |
|---|---|---|
| JP | 57-197665 | 12/1982 |
| JP | 62-085989 | 10/1994 |
| JP | 08-163677 A | 6/1996 |
| JP | 2001-356763 A | 12/2001 |
| JP | 2004-109544 A | 4/2004 |
| JP | 2004-120424 | 4/2004 |

OTHER PUBLICATIONS

Notice of Grounds for Rejection mailed Jun. 9, 2009, for JP Patent Application No. 2004-275139, with English Translation, four pages.

* cited by examiner

*Primary Examiner*—Jeffrey Donels
*Assistant Examiner*—Jeremy Luks
(74) *Attorney, Agent, or Firm*—Morrison & Foerster LLP

(57) ABSTRACT

Recessed section is formed in the rear surface of a speaker box body with a speaker mounted to the inner front surface of the body box. Circuit unit, such as a mixer, including operators is removably accommodated in the recessed section. There is also provided a retention structure for retaining the accommodated circuit unit in the recessed section. When the speaker is to be used, for example, the circuit unit can be removed from the speaker box body and placed near a human player, so that the human player is allowed to, for example, readily operate the operators of the circuit unit. The recessed section may be covered with a lid, in which case speaker-related accessories can be stored in the recessed section.

22 Claims, 7 Drawing Sheets

CIRCUIT-UNIT-COMBINED SPEAKER APPARATUS

BACKGROUND OF THE INVENTION

The present invention relates to a circuit-unit-combined speaker apparatus comprising a speaker box body having a speaker secured thereto, and a circuit unit, including a mixer device, amplifier device etc., for connection to the speaker.

Speaker apparatus including an amplifier provided within a speaker box have been conventionally known, for example, from Japanese Patent Application Laid-open Publication No. 2004-120424. However, the conventionally-known speaker apparatus are not equipped with a function for operating the amplifier. There have also been known speakers, such as guitar amplifiers, which have a function for setting parameters, such as sound volume and sound quality parameters.

Mixers are often used in cases where voices or tones of musical instruments in a performance are to be sounded from a speaker, regardless of whether the performance is a band performance or solo performance, but the mixer and speaker apparatus are generally provided separately from each other. So, it is conceivable to incorporate a mixer device, into a speaker apparatus like the one disclosed in the above-mentioned No. 2004-120424 publication. However, according to the conventional technical idea, even where the amplifier and mixer section can be incorporated into the speaker box, these devices are only secured to the speaker box in such a manner that they can not be detached or removed from the speaker box.

However, the conventionally-known technique, in accordance with which the amplifier and mixer section are fixedly (i.e., unremovably) incorporated in the speaker box, has limited usability and poor user-friendliness because, in this case, the human player has to stay near the speaker apparatus, although the player himself (or herself) can advantageously set and change parameters for the amplifier and mixer.

Speaker apparatus, mixer, etc., which can be used personally by a human player so that no large-scale PA device has to be used, will be useful or convenient; in this case too, it is useful to construct the speaker apparatus, mixer, etc. in such a manner that they can be easily carried into and out of a stage, event site or the like.

SUMMARY OF THE INVENTION

In view of the foregoing, it is an object of the present invention to provide an improved speaker apparatus which can be used and carried with ease.

In order to accomplish the above-mentioned object, the present invention provides an improved speaker apparatus, which comprises: a speaker box body (1) having a speaker (3) mounted therein and having a recessed section (1A) formed in one surface thereof, a circuit unit (2) removably accommodated in the recessed section of the speaker box body; and a retention structure (11, 11*a*, 11*b*, 22*a*; 12, 12*a*, 12*b*, 12*c*, 24; 2') for retaining the circuit unit, removably accommodated in the recessed section, in the recessed section. Note that numerals in parentheses above and below correspond to reference numerals attached to various component parts, members etc. employed in embodiments of the invention to be later described in relation to the accompanying drawings and are added here to facilitate understanding of the summary of the invention.

According to the present invention, the circuit unit (such as a mixer device and amplifier device) is removably stored in the recessed section formed in the speaker box body. Thus, when the speaker apparatus is to be used, the circuit unit, such as a mixer device and amplifier device, can be removed or detached from the speaker box body and placed, as a separate component, near a human player. As a consequence, the human player can use the circuit unit with utmost ease when, for example, operating operators of the circuit unit. Also, when the speaker apparatus is to be carried into or out of a given place, the circuit unit can be snugly stored into the speaker box body so that the speaker box body and circuit unit can be carried together as a single, integrated combination very easily, which significantly facilitates carrying-in/out of the speaker apparatus and circuit unit. Further, with the retention structure for retaining the circuit unit, removably accommodated in the recessed section, in the recessed section, the circuit unit can be reliably retained in the recessed section during the carrying-in/out.

In an embodiment, the retention structure includes: an engaging section provided on a peripheral edge portion of the recessed section of the speaker box body; and an engagement section provided on the circuit unit at a position corresponding to the engaging section. The engagement section of the circuit unit is engaged by the engaging section of the speaker box body with the circuit unit accommodated in the recessed section, so that the circuit unit is retained in and to the speaker box body.

In another embodiment, the retention structure includes: a locking member (12, 12*a*, 12*b*, 12*c*, 24) for securing the circuit unit to the speaker box body; an engaging section (11, 11*a*, 11*b*) provided on a peripheral edge portion of the recessed section of the speaker box body; and an engagement section (22*a*) provided on the circuit unit at a position corresponding to the engaging section. When the circuit unit is to be accommodated in the recessed section, the engagement section of the circuit unit is engaged by the engaging section of the speaker box body, and the circuit unit is secured to the speaker box body via the locking member.

According to another aspect of the present invention, there is provided a speaker system, which comprises: a first speaker apparatus comprising a speaker apparatus to which is removably attachable a circuit unit arranged in the above-described manner; and a second speaker apparatus comprising: a speaker box body (1') having a speaker (3') mounted therein and having a recessed section (1A') formed in one surface thereof, one or more desired articles (M, C2-C5) being removably storable in the recessed section as far as the storage size of the recessed section permits; and a retention member for retaining the articles (M, C2-C5), removably stored in the recessed section of the speaker box body, in the recessed section. With such arrangements, parts and/or accessories, such as a microphone and/or connecting cord, required in the speaker system can be snugly stored in the recessed section of the speaker apparatus and carried together with the second speaker apparatus, which can significantly facilitate carrying-in/out of the speaker apparatus and desired articles.

According to still another aspect of the present invention, there is provided a speaker apparatus, which comprises: a speaker box body (1; 1') having a speaker (3; 3') mounted therein and having a recessed section (1A; 1A') formed in one surface thereof, one or more desired articles (2; M, C2-C5) being removably storable in the recessed section as far as the storage size of the recessed section permits; a lid (2') for covering a circuit unit (2) removably accommodated in the recessed section of the speaker box body, or covering the recessed section of the speaker box body; and a retention structure (11, 11*a*, 11*b*, 22*a*, 12, 12*a*, 12*b*, 12*c*, 24; 11', 11*a*', 11*b*', 22*a*', 12', 12*a*', 12*b*', 12*c*', 24') for retaining the circuit unit, removably accommodated in the recessed section of the speaker box body, to the speaker box body, or retaining the lid to the speaker box body. In the present invention, any desired one of the circuit unit and the lid is attachable to the speaker apparatus via the retention structure. The same speaker apparatus (i.e., speaker apparatus of the same construction) can be used either for storage of the circuit unit or for storage of one or more other desired articles (e.g., speaker-related necessities as mentioned above), and thus can be used with ease (i.e., user-friendly).

In an embodiment, a given comment or illustration, indicative of for example how to use the circuit unit, is indicated on the lid, which permits a further enhanced ease of use.

In an embodiment, the circuit unit has a stand-mounting section, and, when the circuit unit is in a state removed from the recessed section of the speaker box body, the circuit unit is mountable to a given stand via the stand-mounting section. In the state removed from the speaker box body, the circuit unit can be mounted to the stand and thus can be used with an even further enhanced ease.

Further, the stand-mounting section is provided at a position invisible from outside when the circuit unit is accommodated in the recessed section of the speaker box body, which can thereby enhance the outer appearance of the speaker apparatus with the circuit unit stored in the speaker box body.

In an embodiment, the speaker box body has a stand-mounting section provided on a surface thereof other than the surface of the speaker box body toward which the front surface of the speaker faces, and the stand-mounting section of the circuit unit is constructed similarly to the stand-mounting section of the speaker box body. Thus, the respective stands to be used for the circuit unit and speaker box body can be of the same construction (i.e., same product); that is, the same product can be used conveniently for both of the circuit unit and the speaker box body, which can even further enhance the usability and ease of use of the inventive speaker apparatus.

As an embodiment, the retention structure may employ an engagement structure, based on resilient force of a resilient member and frictional force, between the engaging section and engagement section. In such a case, even if the number of other fastening or securing members (such as screws) is reduced, the circuit unit or locking member (i.e., dropout preventing member) can be reliably retained to the speaker box body and yet can be attached and detached with an increased ease.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1:
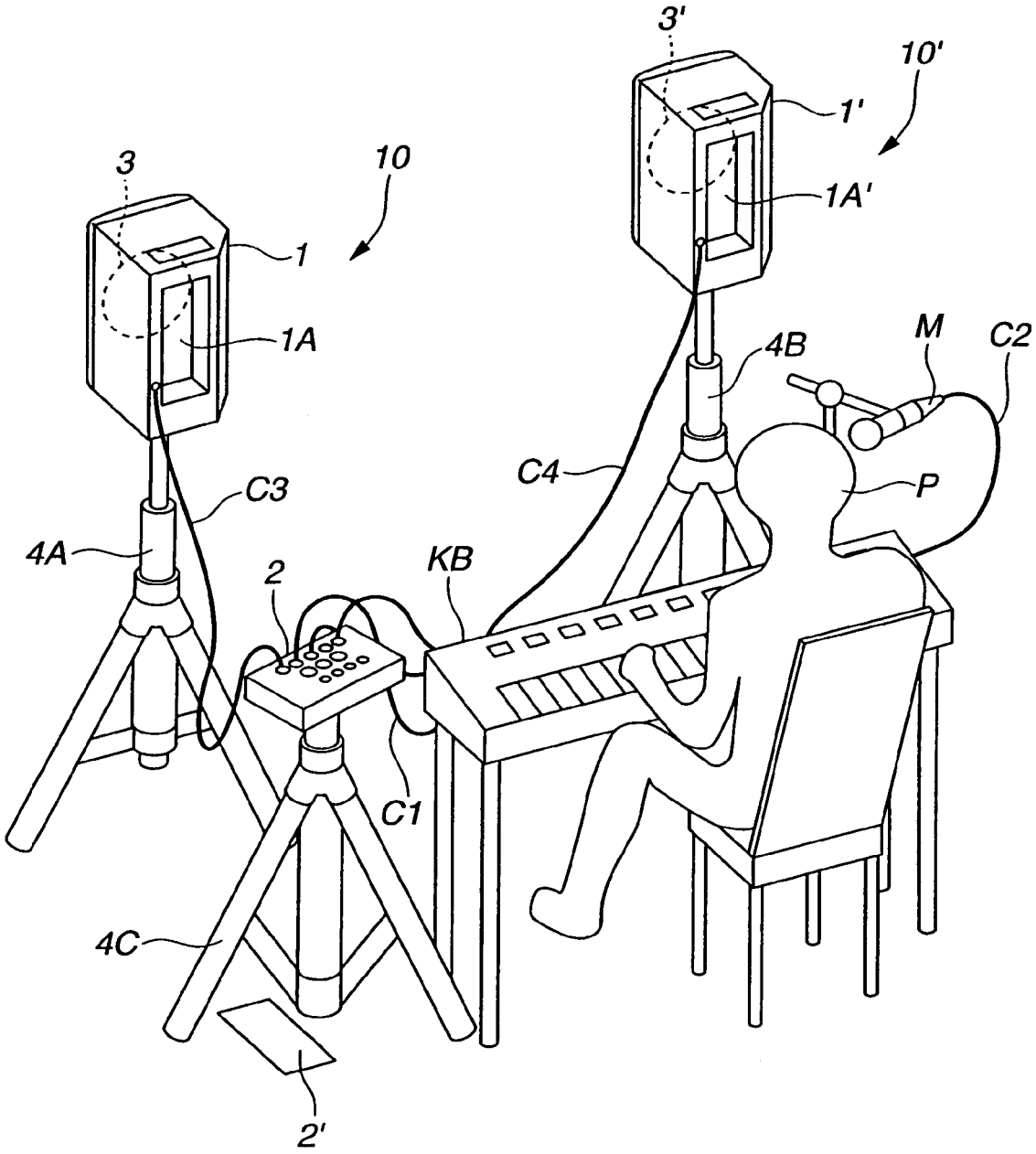
FIG. 1 is a view showing an example manner in which is used a circuit-unit-combined speaker apparatus according to an embodiment of the present invention.

FIG. 1 is a view showing an example manner in which is used a circuit-unit-combined speaker apparatus according to an embodiment of the present invention. In the illustrated example, another type of speaker apparatus (i.e., second speaker apparatus) 10' with no circuit unit combined therewith is used in addition to the circuit-unit-combined speaker apparatus (i.e., first speaker apparatus) 10. The circuit-unit-combined speaker apparatus 10 comprises a speaker box body 1 and a mixer device 2 as the circuit unit mountable in a rear surface region of the speaker box body 1 via an appropriate retention structure, which are separable from each other; in the illustrated example of FIG. 1, the speaker box body 1 and the mixer device 2 are shown as used in a mutually-separated state. The second speaker apparatus 10' comprises a speaker box body 1' and a back lid 2' provided on a back surface of the box body 1' to function as a "dropout preventing member" or "retaining member" (see also FIG. 5), which are also separable from each other; in FIG. 1, the speaker box body 1' and the back lid 2' are shown as separated from each other. Within each of the speaker box bodies 1 and 1', a speaker 3 or 3' is secured to the front inner surface of the box body 1 or 1'. In the circuit-unit-combined (first) speaker apparatus 10 and the second speaker apparatus 10', the respective speaker box bodies 1 and 1' are generally identical to each other in construction, but the respective mixer device 2 and back lid 2' are different from each other in construction.

The speaker box bodies 1 and 1' and mixer device 2 are held by tripod stands 4A, 4B and 4C, respectively. In the illustrated example, a human player P can play a keyboard (electronic musical instrument) KB and sing a song with a microphone M. The keyboard KB and microphone M are connected to the mixer device 2 via cables C1 and C2, respectively. Further, the speaker box bodies 1 and 1' (i.e., their circuitries) are connected to the mixer device 2 via cables C3 and C4, respectively. Audio signal generated through the performance on the keyboard KB and audio signal (voice signal) generated by the microphone M are mixed by the mixer device 2, and the resultant mixed left and right signals of stereo two channels are supplied to and audibly produced (i.e., sounded) by the respective speakers 3 and 3' in the speaker box bodies 1 and 1'. In the illustrated example, where the mixer device 2 is separated from the speaker box body 1, the mixer device 2 can be placed near the human player P, so that the player P can manipulate the mixer device 2 with ease. The mixer device 2 may be constructed in such a manner that a plurality of input/ output components (e.g., microphone, musical instrument, etc.) can be connected to the mixer device 2 so that a plurality of human players can use the mixer device 2.

Each of the speaker box bodies 1 and 1' has a recessed section 1A or 1A' in its rear surface. When the speaker apparatus 10 and 10' are to be carried out of or into a given place, the mixer device 2 is fitted and stored into the recessed section 1A of the speaker box body 1 and thereby closes or lid the recessed section 1A. The cables C1-C4 and microphone M are stored into the recessed section 1A' of the other or second speaker box body 1', and then the recessed section 1A' is closed by the back lid 2'. Thus, as the two speaker apparatus 10 and 10' are carried, the mixer device 2, cables C1-C4 and microphone M can be carried collectively together with the speaker apparatus 10 and 10'.

Figure 4A:
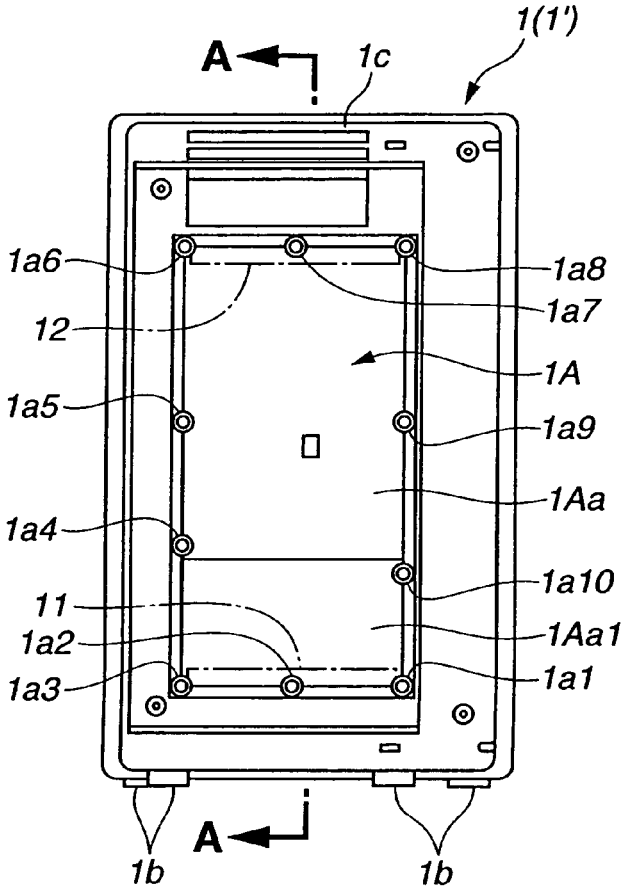
FIGS. 4A-4C are a rearview, sectional side view and bottom view, respectively, which show details of a speaker box body employed in the circuit-unit-combined speaker apparatus of the invention.
Figure 4B:
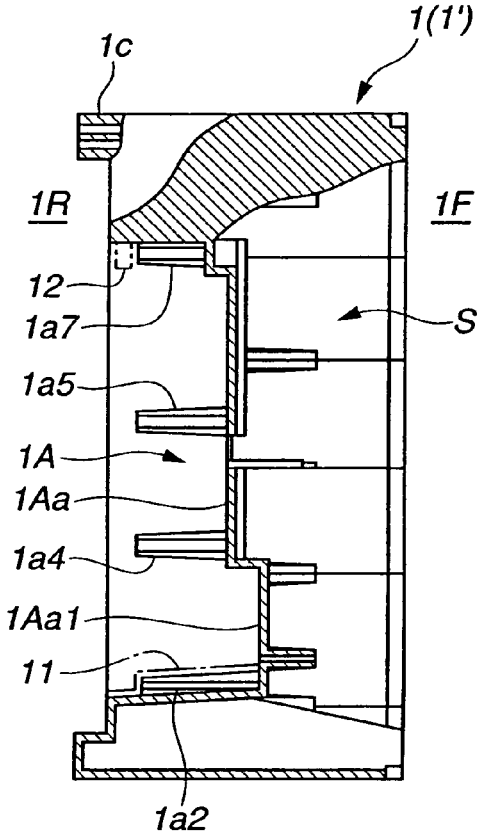
Figure 4C:
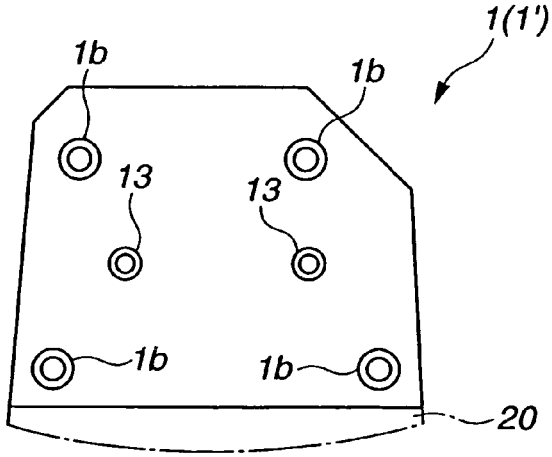

FIGS. 4A-4C are views showing details of the speaker box body 1 or 1'; FIG. 4A is a rear view, FIG. 4B is a sectional side view taken along the A-A line of FIG. 4A, and FIG. 4C is a bottom view. Because the two speaker box bodies 1 and 1' are constructed generally identically to each other as stated above, only the speaker box body 1 will be representatively described hereinbelow in relation to FIGS. 4A-4C. In FIGS. 4A and 4B, the speaker box body 1 is shown as in a normal erected position where the top-to-bottom direction of the speaker box body 1 corresponds to the top-to-bottom direction of the figures. Left side of FIG. 4B will be referred to as "rear surface side" IR, while a right side of FIG. 4B will be referred to as "front surface side" IF.

The speaker box body 1 is formed by synthetic resin molding, and the recessed section 1A, having a rectangular opening that opens rearwardly, is formed in the rear surface side IR of the speaker box body 1. A plurality of bosses 1*a*1-1*a*9 are formed on the inner peripheral surface and corners of the recessed section 1A. Bottom plate portion 1Aa of the recessed section 1A is located substantially centrally within the speaker box body 1, and the bottom plate portion 1Aa has, in its lower end portion, a stepped portion 1Aa1 concaved toward the front surface side 1F. Space located forwardly of the bottom plate portion 1Aa (i.e., nearer to the front surface side 1F than the bottom plate portion 1Aa) is provided as a speaker chamber S for fixedly accommodating the speaker 3; the speaker 3 is installed in the speaker chamber S. Front case 20 (indicated by a dot-and-dash line in FIG. 4C), provided with a baffle plate and saran net, is secured to a front outer edge of the forwardly-open opening of the speaker chamber S.

As indicated by dot-and-dash lines in FIGS. 4A and 4B, an engaging member 11, constituting an engaging section, is screwed to the bosses 1*a*1-1*a*3 on the inner surface of the recessed section 1A, and a locking member 12, constituting a locking means, is screwed to the bosses 1*a*6-1*a*8. The speaker box body 1 has four foot portions 1*b* slightly projecting downward from four positions of the underside of the body 1, and these four foot portions 1*b* are located near the corners of the underside. Further, two stand-engaging (or stand-mounting) sections 13 are provided at two positions of the underside which are located centrally in the front-and-rear direction of the underside of the box body 1. These stand-engaging sections 13 are similar in construction to stand-engaging sections 23 of the mixer device 2 which will be described later. Further, a handle section 1*c* is formed integrally on the speaker box body 1, by forming part of the body 1 into a through-hole.

Figure 2:
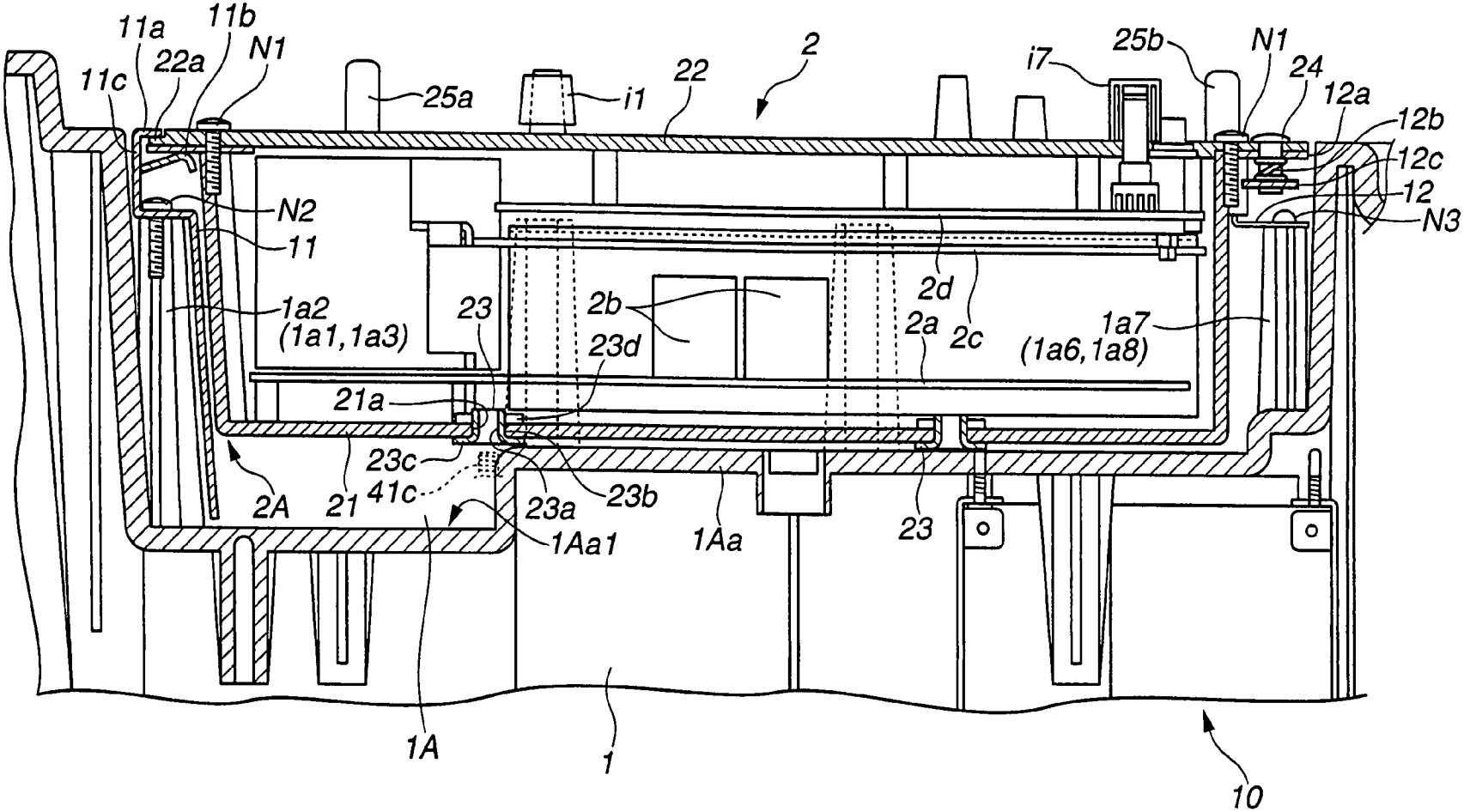
FIG. 2 is a sectional view showing in enlarged scale relevant sections of the circuit-unit-combined speaker apparatus of the invention.
Figure 3:
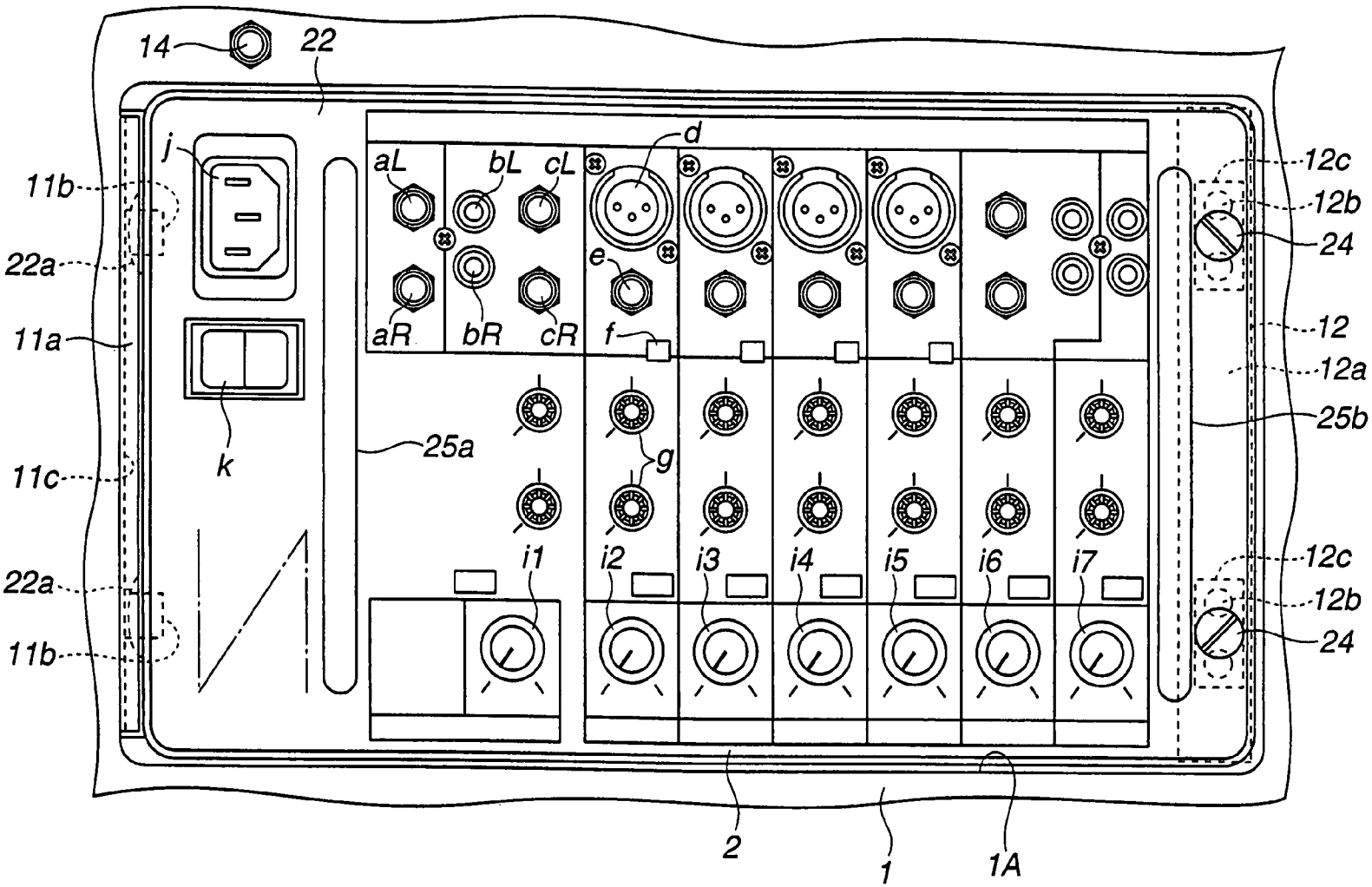
FIG. 3 is a rear view showing in enlarged scale relevant sections of the circuit-unit-combined speaker apparatus of the invention.

FIG. 2 is a sectional view showing in enlarged scale principal or relevant sections of the circuit-unit-combined speaker apparatus 10 and FIG. 3 is a rear view showing in enlarged scale relevant sections of the circuit-unit-combined speaker apparatus 10, which particularly show that the mixer device 2 is fitted and stored in the recessed section 1A of the speaker box 1. As seen in FIG. 2, an outer casing of the mixer device 2 is formed by securing a panel plate 22 to a body case 21, in the shape of a rectangular box, by means of screws N1. Within the body case 21, there is accommodated electronic circuitry for performing both a mixer function and an amplifier function, such as a main substrate 2*a*, circuit components 2*b*, subsidiary substrate 2*c* and operation section substrate 2*d*.

Now, with reference to FIGS. 2 and 3, a description will be given about an example of the retention structure employable in the present invention.

The retention structure includes the engaging member 11 which is fastened to the bosses 1*a*1-1*a*3 by means of a screw N2. This engaging member 11, which is formed by bending a resilient plate of stainless steel or the like, has a claw portion 11*a* formed by bending a distal end portion of the resilient plate inwardly into the opening of the recessed section 1A, and leaf spring portions 11*b* bent deeper into the recessed section 1A than the claw portion 11*a*. Reference numeral 11*c* represents a flat wall portion of the engaging member 11.

The panel plate 22 of the mixer device 2 has a contour generally fittable in the opening of the recessed section 1A, and it has two claw portions 22*a* projecting arcuately from two positions of the lower edge thereof. The mixer device 2 is inserted in the recessed section 1A with these two claw portions 22*a* sandwiched between the claw portion 11*a* and leaf spring portions 11*b* of the engaging member 11; thus, the leaf spring portions 11*b* are depressed, against its resiliency, by the rear surface of the claw portions 22*a* with the claw portions 22*a* of the panel plate 22 engaging with the claw portion 11*a* of the engaging member 11. Then, by the later-described locking means fastening the mixer device 2 to the speaker box body 1, the mixer device 2 is secured to the speaker box body 1 via the claw portion 11*a* and leaf spring portions 11*b* of the engaging member 11. Namely, the claw portions 22*a* constitute an "engagement section", while the claw portion 11*a* and leaf spring portions 11*b* constitute the "engaging section". The claw portion 11*a* of the engaging member 11 has a thin resin sheet affixed thereto, so that only this resin sheet is visible from outside.

Figure 7:
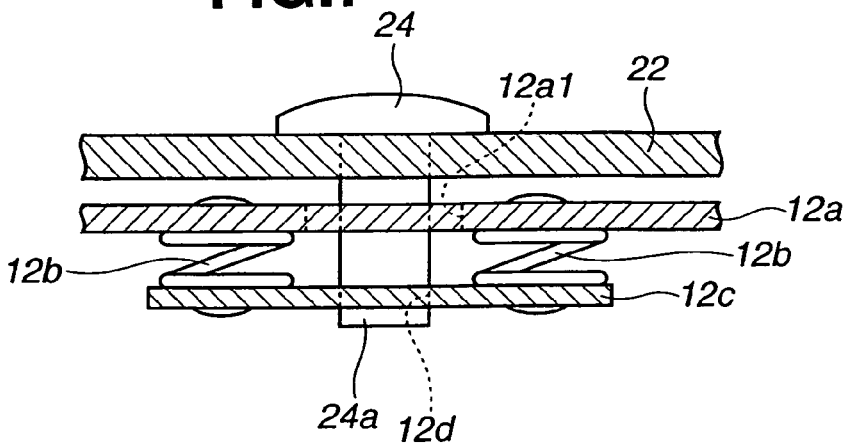
FIG. 7 is an enlarged side view showing relevant portions of a locking member employed in the circuit-unit-combined speaker apparatus of the invention.

The locking member 12 is fastened to the bosses 1*a*6-1*a*8 by means of a screw N3. This locking member 12 is formed into a channel-shaped cross section by, for example, bending a steel plate, and it has a flat portion 12*a* (extending horizontally in FIG. 2 and thus will hereinafter be referred to as "horizontal portion") bent up to the end edge of the opening of the recessed section 1A. The horizontal portion 12*a* has two nut plates 12*c* secured to two positions thereof via respective springs 12*b*. FIG. 7 is an enlarged side view of the locking member 12 and nut plate 12*c* that constitute principal sections of the locking means. As shown, each of the nut plates 12*c* has a screw hole 12*d* formed therein, and the horizontal portion 12*a* has a through-hole 12*a*1 formed therein at a position opposed to the screw hole 12*d*.

Further, on the panel plate 22 of the mixer device 2, a fastening screw 24 is rotatably provided near the upper edge of the panel plate 22 at a position corresponding to the screw hole 12*d* of the corresponding nut plate 12*c*. Threaded portion 24*a* of the fastening screw 24 is screwed through the through-hole 12*a*1 into the screw hole 12*d* of the nut plate 12*c* with the mixer device 2 fixed via the above-mentioned engagement section and engaging section, so that the mixer device 2 is secured to the speaker box body 1. Namely, the locking member 12, springs 12*b*, nut plates 12*c* of the speaker box body 1 and the fastening screws 24 of the mixer device 2 constitute a group of the "locking members".

Figure 8:
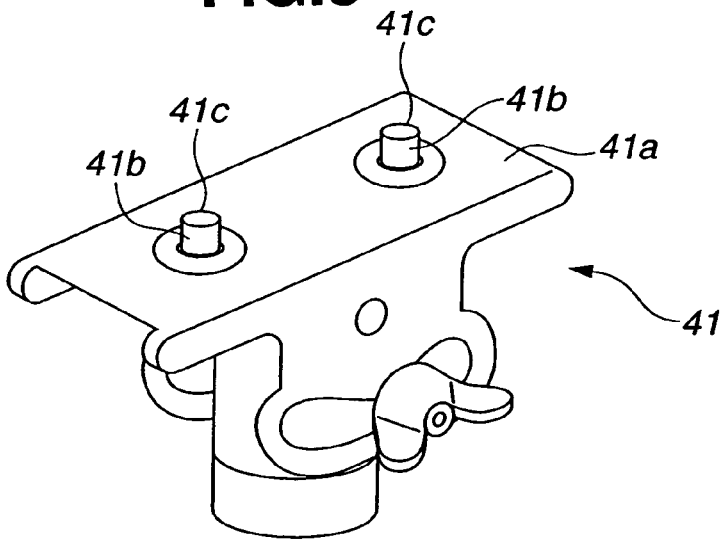
FIG. 8 is an enlarged perspective view showing a bracket section for speaker and mixer stands in the circuit-unit-combined speaker apparatus of the invention.

As illustrated in FIG. 2, the stand-engaging sections 23 are provided at two positions of a bottom plate section 21A of the mixer body case 21. As shown in FIG. 2, the stand-engaging sections 23 are each in the form of a threaded member having an inner threaded portion 23*a*, outer threaded portion 23*b* and flange portion 23*c*. Each of the stand-engaging sections 23 is first passed through a corresponding hole 21*a* of the body case 21 until the flange portion 23*c* is brought into close contact with the rear surface of the body case 21 and then a nut 23*d* is screwed, from the interior of the case 21, onto the outer threaded portion 23*b*; in this way, the stand-engaging sections 23 are secured in place. FIG. 8 is an enlarged perspective view showing a bracket section (mounting support section) 41 that can be used for speaker and mixer stands. Two bracket screws 41*b* are rotatably provided on a base 41*a*, and a distance between the two bracket screws 41*b* is equal to a distance between the two stand-engaging sections 23 of the mixer device 2. The mixer device 2 is attached to the bracket section 41 by screwing a threaded portion 41*c* of the bracket screw 41*b* to the inner screw portion 23*a* of the stand-engaging section 23 (see FIG. 2).

The stand-engaging sections 13 on the underside of the speaker box body 1 are similar in construction to the stand-engaging sections 23 of the mixer device 2, and the distance between the stand-engaging sections 13 is equal to the distance between the stand-engaging sections 23. Therefore, the speaker box body 1 can also be attached to the bracket section 41 in a similar manner to the above-described.

As shown in FIG. 3, the panel plate 22 of the mixer device 2 has a pair of upper and lower handles 25*a* and 25*b* provided thereon, so that the mixer device 2 can be attached to or detached from the recessed section 1A by a human operator holding the handles 25*a* and 25*b*; note that either or both of the handles 25*a* and 25*b* may be dispensed with. On the panel plate 22, there are provided speaker output terminals aL and aR for left and right speakers of stereo two channels, recorder output terminals bL and bR, and expanded power speaker output terminals cL and cR. On the panel plate 22, there are also provided a microphone input terminal d, line input terminal e, microphone/line selecting switch f, reverberation adjusting knob g, channel level knobs i2-i7, master level knob i1, A.C. power connector j, power switch k, etc. Further, a jack (terminal) 14 for connection thereto the cable C3 (or C4) from the mixer device 2 is provided on the speaker box body 1 near the recessed section 1A.

Figure 5:
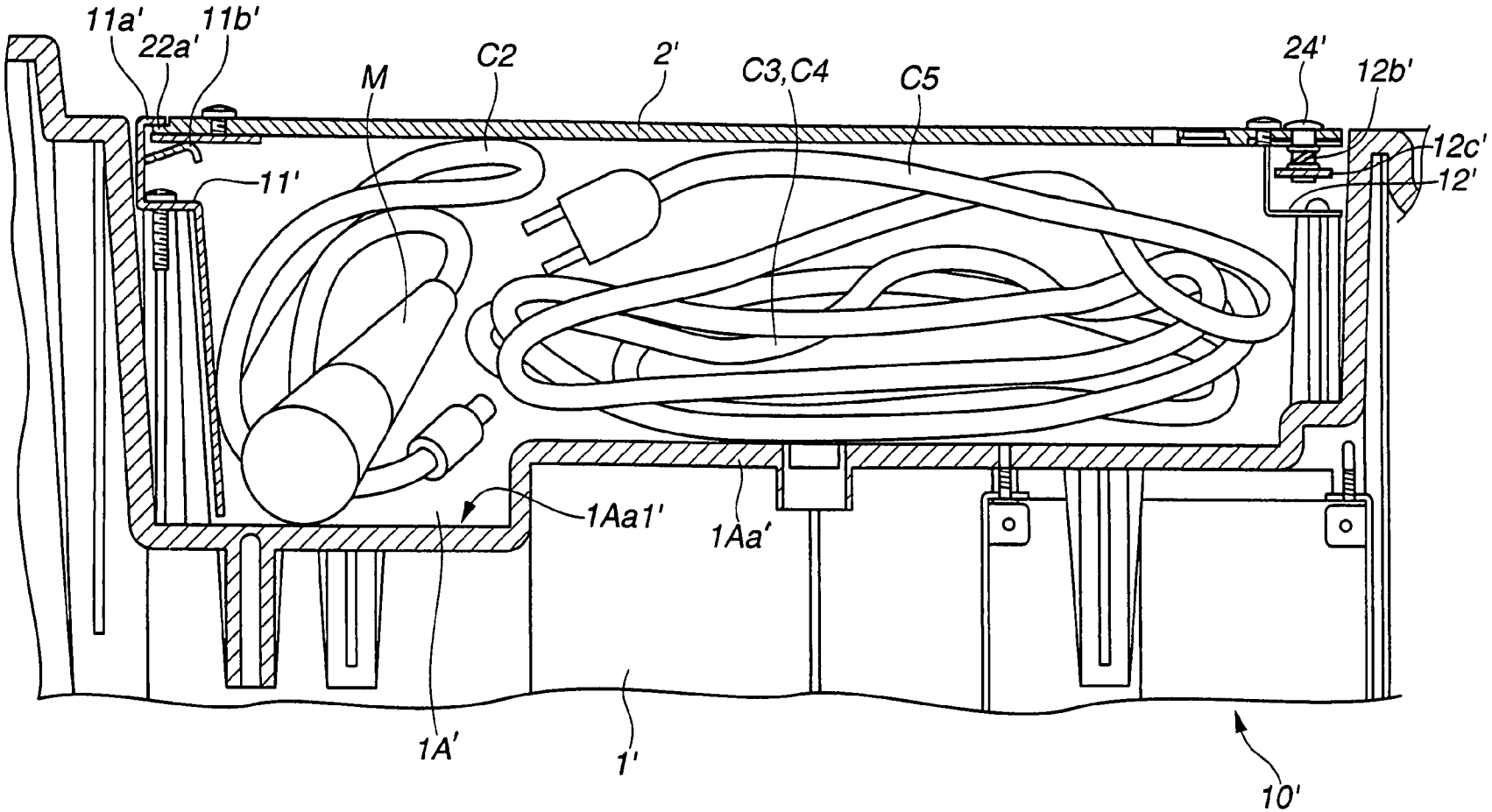
FIG. 5 is a sectional side view showing in enlarged scale principal or relevant sections of a second speaker apparatus employed in the circuit-unit-combined speaker apparatus of the invention.
Figure 6:
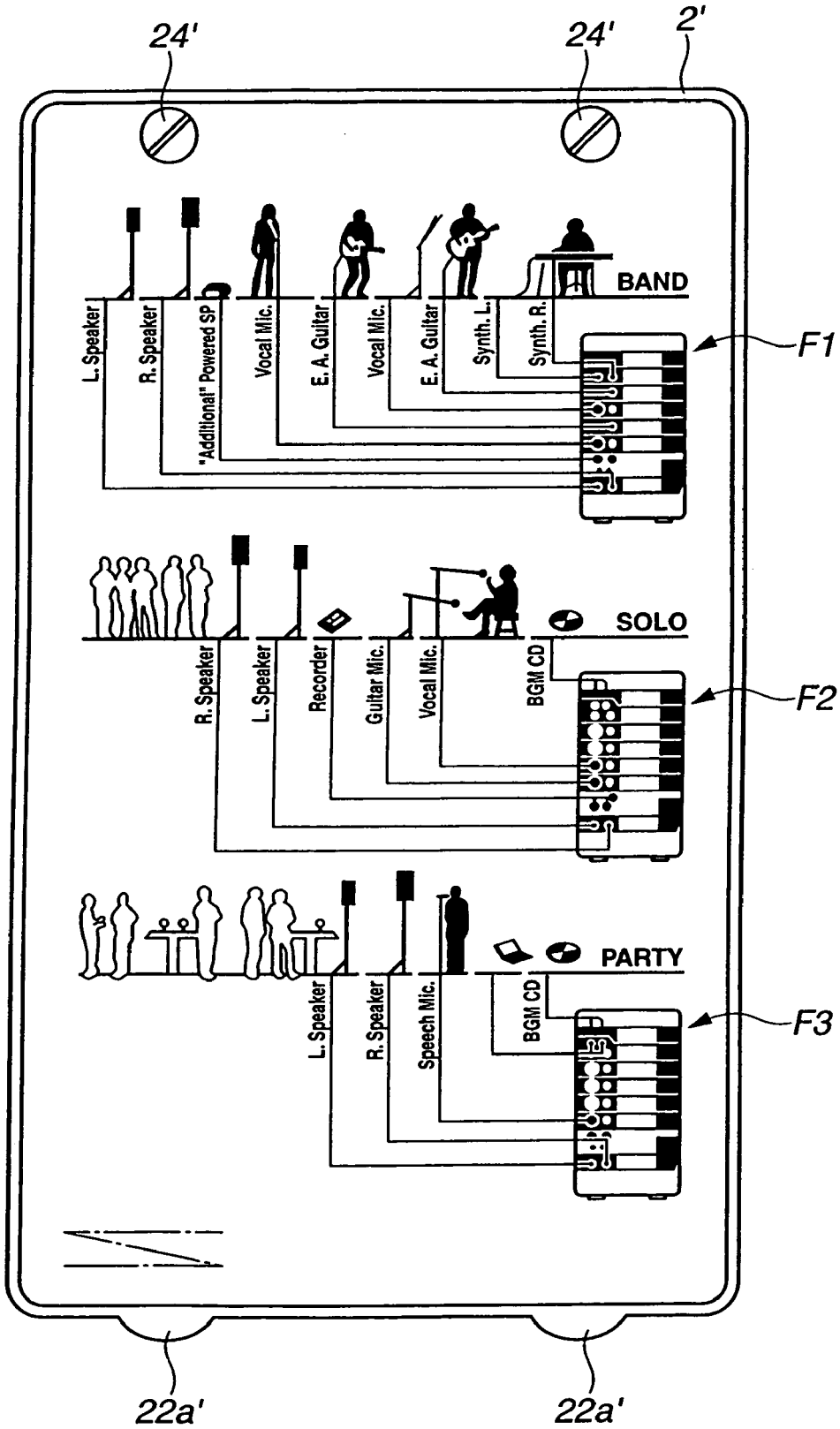
FIG. 6 is an enlarged front view of a back lid employed in the circuit-unit-combined speaker apparatus of the invention.

FIG. 5 is a sectional side view showing in enlarged scale principal sections of the second speaker apparatus 10', and FIG. 6 is a front view of the back lid 2'. In FIG. 5, elements similar to those in the speaker apparatus 10 of FIG. 2 are indicated by the same reference numerals with marks "'" added thereto, and these similar elements will not be described in detail to avoid unnecessary duplication. For example, the speaker box body 1', recessed section 1A', engaging member (engaging section) 11', claw portion (engaging section) 11*a*', leaf spring portions (engaging section) 11*b*', locking member 12', springs (locking members) 12*b*' and nut plates (locking members) 12*c*' are similar in construction to the above-described speaker box body 1, recessed section 1A, engaging member (engaging section) 11, claw portion (engaging section) 11*a*, leaf spring portions (engaging portion) 11*b*, locking member 12, springs (locking members) 12*b* and nut plates (locking members) 12*c*.

The microphone M and its cable C2, the power supply cable C5 and the cables C3 and C4 interconnecting the mixer device 2 and the speaker box bodies 1 and 1' are together stored in the recessed section 1A' of the speaker box body 1'. The back lid 2' has a contour generally fittable in the opening of the recessed section 1A and is fittingly attached to the opening of the recessed section 1A'. Therefore, during carrying of the second speaker apparatus 10' too, the microphone M and cables C2-C4 can be effectively prevented from dropping out of the recessed section 1A', by the back lid 2' functioning as a "dropout preventing member" or "retaining member".

As shown in FIG. 6, the back lid 2' has two claw portions 22*a*' projecting arcuately from two positions of the lower edge thereof. These claw portions 22*a*' and claw portions 11*a*' and leaf spring portions 11*b*' of the engaging member 11' perform engagement functions in a similar manner to the above-described claw portions 22*a*, claw portion 11*a* and leaf spring portions 11*b* of the speaker device 10 shown in FIG. 2. Namely, in this case too, the claw portions 22*a*' constitute an "engagement section", and the claw portions 11*a*' and leaf spring portions 11*b*' constitute an "engaging section". Further, on the back lid 2', fastening screws 24' are rotatably provided, near the upper edge of the lid 2', at positions corresponding to the fastening screws 24 of the mixer device 2. The back lid 2' is secured to the speaker box body 1' by screwing the fastening screws 24' to the nut plates 12*c*', in generally the same manner as shown in FIG. 2, with the back lid 2' engaged via the engaging and engagement sections. Namely, in this case too, the locking member 12', springs 12*b*', nut plates 12*c*' of the speaker box body 1' and the fastening screws 24' of the back lid 2' constitute a group of "locking members".

Namely, in each of FIGS. 2 and 5, the mixer device 2 or back lid 2' is secured to the speaker box body 1 or 1' by the resilient force of the leaf spring portion (resilient member) 11*d* or 11*d*' and frictional force between the claw portions 22*a* or 22*a*' and the claw portions 11*a* or 11*a*'. Thus, the mixer device 2 or back lid 2' can be detachably attached with an extremely small number of screws (two screws in the illustrated example) in the group of locking members.

Further, in the described embodiment, the stepped portions 1Aa1 and 1Aa1' are formed in the recessed sections 1A and 1A', to provide considerable spatial room. Thus, when the mixer device 2 is to be installed in the recessed section 1A, it can be readily inserted into the recessed section 1A without a corner portion 2A (see FIG. 2) of the mixer device 2 interfering with the bottom plate portion 1Aa of the recessed section 1A. Further, in the recessed section 1A', members of relatively great sizes, such as the microphone M, can be accommodated in a considerably great or deep space defined by the stepped portion 1Aa1' while deformable members, such as a bunch of the flexible cables C3-C5, can be accommodated in a shallower space defined by the other portions of the bottom plate portion 1Aa than the stepped portion 1Aa1', as illustrated in FIG. 5. In such a case, the cables C3-C5 etc. may be sandwiched between the back lid 2' and the bottom plate portion 1Aa' in such a manner that the cables C3-C5 etc. can be stored and effectively prevented, by frictional force, from being displaced within the recessed section 1A'.

The bottom plate portion 1Aa (1Aa') of the recessed section 1A (1A') and bottom and side surfaces, continuing from the bottom plate portion 1Aa (1Aa'), form generally flat surfaces. Thus, although the bottom and side surfaces of the recessed section 1A (1A') are exposed to the outside, as seen in FIG. 1, when the circuit unit (mixer device 2) or lid 2' is removed, there will be encountered no substantial inconvenience in terms of the functions and appearance.

As seen in FIG. 6, typical examples of connections using the mixer device 2 or use of the mixer device 2) are indicated, on the surface of the back lid 2', via three drawings F1-F3. The first drawing F1 illustrates use of the mixer device 2 in a band performance, the second drawing F2 illustrates use of the mixer device 2 in a solo performance, and the third drawing FIG. 3 illustrates use of the mixer device 2 in a party. Each of the drawings F1-F3 comprises schematic illustrations of one or more human players, audience, MC, participants, speaker box body, one or more musical instruments, other equipment, such as a recorder, panel plate 22 of the mixer device 2 and cables connecting the mixer device 2 and the equipment. Because there are displayed, on the surface of the back lid 2', examples of use of the circuit-unit-combined speaker apparatus of the invention in the above-described manner, it is possible to readily know how to use (or how to connect) the mixer device 2; thus, the mixer device 2 is very user-friendly even for a beginner user.

In the described embodiment, the mixer device 2 employed as the "circuit unit" has the mixer function and amplifier function. Alternatively, the circuit unit mounted in the speaker box body may comprise other than the mixer device, such as an amplifier device, effect impartment device or other device that is constructed to perform other appropriate signal processing on sound signals to be supplied to the speaker.

Further, the "engaging section", "engagement section" and "locking members" are not limited to those in the above-described preferred embodiment and may be constructed in any other suitable manner as long as they can secure one side of the mixer device and back lid near the edge of the opening of the recessed section in the speaker box body and also secure other portions (preferably opposite from the engaging section) of the mixer device and back lid near the edge of the opening of the recessed section.

Figure 9:
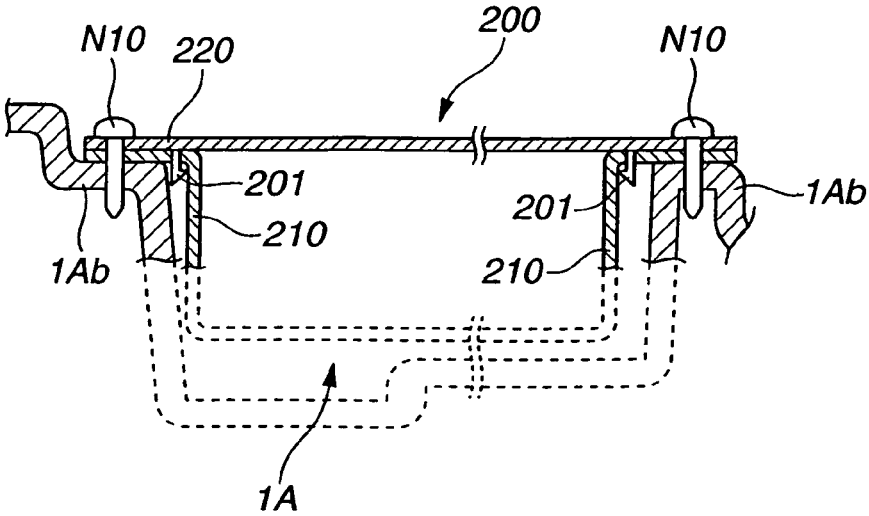
FIG. 9 is an enlarged sectional side view of a retention structure according another embodiment of the present invention.

Now, with reference to FIG. 9, a description will be given about another example of the retention structure employable in the present invention. FIG. 9 is a side sectional view similar to FIG. 2, which extractively illustrates a retention structure for retaining the circuit unit (mixer device etc.) 200 in and to the speaker box body 1. Body case 210 of the circuit unit 200 has an outer peripheral edge portion extending so as to overlap a peripheral edge portion 1Ab of the recessed section 1A of the speaker box body 1, in correspondence with which the outer peripheral edge portion of the panel plate 220 is expanded as compared to the counterpart of FIG. 2. The panel plate 220 has downward hook claws 201 formed at an appropriate plurality of positions (e.g., four positions) of the underside thereof. The body case 210 has a plurality of engaging holes formed in the outer peripheral edge portion at positions corresponding to the hook claws 201. The panel plate 220 is fixed to the body case 210 by the hook claws 201 being engaged in the corresponding engaging holes. As shown, overlapped layers of the outer peripheral edge portions of the body case 210 and panel plate 220 of the circuit unit 200 are received on the peripheral edge portion 1Ab of the recessed section 1A of the speaker box body 1 and fastened at an appropriate plurality of positions (e.g., four positions) to the peripheral edge portion 1Ab by means of screws N10. In this way, the circuit unit (mixer device etc.) 200 is held in the recessed section 1A and retained to (i.e., secured to) the speaker box body 1.

Still another example of the retention structure (i.e., structure of the engaging and engaged sections) employable in the present invention may be constructed as follows. For example, an engaging hole may be formed in one of the speaker box and mixer device (or back lid), and a claw insertable in the engaging hole may be formed on the other of the speaker box and mixer device (or back lid); in this case, the speaker box and the mixer device (or back lid) is fixed to each other on a side opposite from the position where the claw is engaged in the engaging hole. The fixing structure may comprise a claw that is provided on the mixer device (or back lid) and resiliently deformable by a finger, and a hole that is formed in the speaker box and engageable with the claw. In another alternative, the engaging and engaged sections may be constructed to secure together the speaker box and mixer device (or back lid) by screws or otherwise.

Further, in a speaker system comprising left and speakers or a plurality of speakers, there may be provided a plurality of the circuit-unit-combined speaker apparatus 10, rather than just one such circuit-unit-combined speaker apparatus 10.

Further, since the speaker box body 1 of the first (circuit-unit-combined) speaker apparatus 10 is constructed similarly to the speaker box body 1' of the second speaker apparatus 10', the accessories, such as the microphone and/or connecting cord, may be stored in the recessed section 1A of the speaker box body 1 of the first speaker apparatus 10 and covered with the lid 2'. Similarly, the circuit unit (mixer device 2) may be accommodated in the speaker box body 1' of the second speaker apparatus 10'. In other words, the circuit unit (mixer device 2) or lid 2' may be mounted to the recessed section 1A or 1A' of any desired one the speaker apparatus 10 and 10' of the present invention; that is, each the speaker apparatus 10 and 10' of the present invention can be selectively used for any one of the functions.

Further, the recessed section 1A in the rear surface side of the speaker box body 1 may be divided into two or more areas, in which case the circuited unit may be detachably attached to one of the divided areas and another of the divided areas may be provided with the back lid (dropout preventing member) to provide a storage space for the cables and microphone.

The recessed section 1A or 1A' for storing the circuit unit, parts, accessories, etc. may be provided in another surface than the rear surface side. Further, the speaker may be provided in a left or right side or topside rather than the front surface side.

Furthermore, the circuit unit may be retained in the recessed section 1A (against dropout from the recessed section 1A) by the back lid 2' closing the recessed section 1A, with no particular fixing, engaging or locking structure provided in the circuit unit.

What is claimed is:

1. A speaker apparatus comprising:

a speaker box body having a speaker mounted on a front surface side thereof, said speaker producing audio signals through said front surface side, a rear surface side of said speaker box body being closed to provide a closed space in said speaker box body, the rear surface side of said speaker box body having a wall concaved inwardly over a predetermined range to provide a recessed section in the rear surface side, the recessed section being partitioned from the closed space in said speaker box body;

a circuit unit removably accommodated in said recessed section of said speaker box body; and a retention structure for retaining said circuit unit, removably accommodated in said recessed section, in said recessed section, wherein the circuit unit is a mixer device having various manipulators; and wherein the mixer device is accommodated in said recessed section so that the mixer device faces the closed space.

2. A speaker apparatus as claimed in claim 1 wherein said retention structure includes:

an engaging section provided on a peripheral edge portion of said recessed section of said speaker box body; and an engagement section provided on said circuit unit at a position corresponding to said engaging section, wherein said engagement section of said circuit unit is engaged by said engaging section of said speaker box body with said circuit unit accommodated in said recessed section, so that said circuit unit is retained in and to said speaker box body.

3. A speaker apparatus as claimed in claim 1 wherein said retention structure includes:

a locking member for securing said circuit unit to said speaker box body;

an engaging section provided on a peripheral edge portion of said recessed section of said speaker box body; and an engagement section provided on said circuit unit at a position corresponding to said engaging section, wherein, when said circuit unit is to be accommodated in said recessed section, said engagement section of said circuit unit is engaged by said engaging section of said speaker box body, and said circuit unit is secured to said speaker box body via said locking member.

4. A speaker apparatus as claimed in claim 1 wherein said circuit unit is connected to the speaker mounted in said speaker box body, and, even when said circuit unit is in a state removed from said recessed section of said speaker box body, said circuit unit is connectable, via wiring, to the speaker in said speaker box body.

5. A speaker apparatus as claimed in claim 4 wherein said manipulators include an operator operable by a human operator to control or adjust a sound signal to be supplied to the speaker, and wherein, when said circuit unit is at a position separated away from said speaker box body, the sound signal to be supplied to the speaker can be controlled or adjusted through operation of said operator.

6. A speaker apparatus as claimed in claim 1 wherein said recessed section is formed over a range greater than half of an entire area of the rear surface side.

7. A speaker apparatus as claimed in claim 1 wherein said circuit unit has a stand-mounting section, and, when said circuit unit is in a state removed from said recessed section of said speaker box body, said circuit unit via said stand-mounting section is mountable to a given stand.

8. A speaker apparatus as claimed in claim 7 wherein said stand-mounting section is provided at a position invisible from outside when said circuit unit is accommodated in said recessed section of said speaker box body.

9. A speaker apparatus as claimed in claim 7 wherein said speaker box body has a stand-mounting section provided on a surface thereof other than a surface of said speaker box body toward which a front surface of the speaker faces, and the stand-mounting section of said circuit unit is constructed similarly to the stand-mounting section of said speaker box body.

10. A speaker system comprising:

a first speaker apparatus comprising:

a first speaker box body having a first speaker mounted on a front surface side thereof, said speaker producing audio signals through said front surface side, a rear surface side of said first speaker box body being closed to provide a closed space in said first speaker box body, the rear surface side of said first speaker box body having a wall concaved inwardly over a predetermined range to provide a first recessed section in the rear surface side, the first recessed section being partitioned from the closed space in said first speaker box body;

a circuit unit removably accommodated in said first recessed section of said first speaker box body; and a first retention structure for retaining said circuit unit, removably accommodated in said first recessed section, in said first recessed section; and a second speaker apparatus comprising:

a second speaker box body having a second speaker mounted therein and having a second recessed section formed in one surface thereof, one or more desired articles being removably storable in said second recessed section as far as a storage size of said second recessed section permits; and a retention member for retaining the articles, removably stored in said second recessed section of said second speaker box body, in said second recessed section, wherein the circuit unit is a mixer device having various manipulators; and wherein the mixer device is accommodated in said first recessed section so that the mixer device faces the closed space.

11. A speaker system as claimed in claim 10 wherein said second speaker apparatus further comprises a second retention structure for removably retaining said retention member to said second speaker box body.

12. A speaker system as claimed in claim 10 wherein said retention member is a back panel covering said second recessed section of said second speaker apparatus.

13. A speaker system as claimed in claim 12 wherein a given comment or illustration, indicative of for example how to use said circuit unit, is indicated on said back panel.

14. A speaker system as claimed in claim 10 wherein the articles are parts and/accessories, such as a microphone and/or connecting cord, required in said speaker system.

15. A speaker apparatus as claimed in claim 1, which further comprises a back panel for removably covering said recessed section of said speaker box body in place of said circuit unit, wherein said retention structure retains said back panel to said speaker box body, wherein any desired one of said circuit unit and said back panel is attachable to said speaker apparatus via said retention structure, and wherein, when said circuit unit is not accommodated in said recessed section, one or more desired articles are removably storable in said recessed section as far as a storage size of said recessed section permits.

16. A speaker apparatus as claimed in claim 15 wherein a given comment or illustration, indicative of for example how to use said circuit unit, is indicated on said back panel.

17. A speaker apparatus as claimed in claim 15 wherein said back panel prevents the articles, stored in said recessed section of said speaker box body, from dropping out of said recessed section.

18. A speaker apparatus as claimed in claim 15 wherein said circuit unit has a stand-mounting section, and, when said circuit unit is in a state removed from said recessed section of said speaker box body, said circuit unit is mountable to a given stand via said stand-mounting section.

19. A speaker apparatus as claimed in claim 18 wherein said stand-mounting section is provided at a position invisible from outside when said circuit unit is accommodated in said recessed section of said speaker box body.

20. A speaker apparatus as claimed in claim 18 wherein said speaker box body has a stand-mounting section provided on a surface thereof other than a surface of said speaker box body toward which a front surface of the speaker faces, and the stand-mounting section of said circuit unit is constructed similarly to the stand-mounting section of said speaker box body.

21. A speaker apparatus as claimed in claim 1 which further comprises a back panel for removably covering said recessed section of said speaker box body in place of said circuit unit, and wherein the retention structure retains said panel to said speaker box body, and a drawing related to a predetermined form of use of said circuit unit is provided on a surface of said back panel.

22. A speaker apparatus as claimed in claim 21 wherein the drawing provided on the surface of said back panel indicates a plurality of examples of connections corresponding to a plurality of forms of use of said circuit unit.

* * * * *